United States Patent [19]

Savage et al.

[11] Patent Number: 4,962,665

[45] Date of Patent: Oct. 16, 1990

[54] SAMPLING RESISTIVITY OF FORMATION FLUIDS IN A WELL BORE

[75] Inventors: Kerry D. Savage; Irwin R. Supernaw, both of Houston, Tex.

[73] Assignee: Texaco Inc., White Plains, N.Y.

[21] Appl. No.: 411,786

[22] Filed: Sep. 25, 1989

[51] Int. Cl.[5] ..... E21B 49/10; G01V 3/18

[52] U.S. Cl. ..... 73/155; 324/324

[58] Field of Search ..... 324/324, 325, 367, 374, 324/376; 73/153, 155; 166/250, 252, 264, 265, 100; 175/40, 48

[56] References Cited

U.S. PATENT DOCUMENTS

| | | | |
|---|---|---|---|
| 2,607,222 | 8/1952 | Lane | 324/324 X |
| 3,209,588 | 10/1965 | Terry | 324/367 X |
| 3,611,799 | 10/1971 | Davis | 73/153 X |
| 4,301,679 | 11/1981 | Boyle et al. | 73/155 |
| 4,434,653 | 3/1984 | Montgomery | 73/155 X |

OTHER PUBLICATIONS

"Repeat Formation Tester" Brochure, Schlumberger, 1986, pp. 1–4.

"Essentials of Modern Open-Hole Log Interpretation", PennWell Publishing Co., Tulsa, Okla., 1983, pp. 284–290.

*Primary Examiner*—Gerard R. Strecker

*Attorney, Agent, or Firm*—Jack H. Park; Kenneth R. Priem; Robert A. Kulason

[57] ABSTRACT

Formation fluid is received in and passed through a sonde supported by an armored well logging cable at a depth of interest in a well bore. Periodically, samples of the formation fluid are taken. Higher density portions of the fluid, which represent formation fluid and/or mud filtrate, are separated. The separated fluid is a sample from which the resistivity is measured. As sampling continues, the sample fluid becomes substantially formation fluid and an apparent $R_2$ measurement is made. An electrical signal indicating the $R_2$ at the depth of interest is sent to the surface for recording and further processing. $R_2$ measurements can be taken at any desired number of depths of interest in the well bore.

20 Claims, 1 Drawing Sheet

SAMPLING RESISTIVITY OF FORMATION FLUIDS IN A WELL BORE

BACKGROUND OF INVENTION

1. Field of Invention

The present invention relates to formation sampling to measure resistivity of fluids in formations adjacent well bores.

2. Description of Prior Art

A formation sampling tool known generally as a multiple formation tester has been available from several well logging service companies. Formation testers were primarily used to measure formation fluid pressures at one or two selected depths of interest in a well bore. A feature of the formation tester permitted obtaining as a maximum only two samples of formation fluid during a logging run. The samples were stored in chambers in the formation tester and removed with the tester from the well. The two samples so obtained could then be analyzed at the surface. The gas-oil ratio (GOR) and water cut (WC) measurements of the formation could theoretically then be obtained from the fluid samples. However, the fluid samples obtained normally contained a substantial amount of mud filtrate, which created a major problem in formation water analysis. Partially due to the mud filtrate, the measurements so obtained were treated as only rough predictions of expected petroleum production.

SUMMARY OF INVENTION

Briefly, the present invention relates to sampling resistivity of fluids in a formation adjacent a well bore. A sonde is lowered into the well bore by a logging cable to a desired depth adjacent a formation of interest. A mixture of fluids from the formation is conveyed or passed through the sonde. The mixture of fluids moving in the sonde is periodically sampled. The relatively denser formation fluid in the sample periodically taken is then separated from the constituent formation gas and oil in the sample. A measurement of the resistivity of the separated water from the formation fluid is then made and sent up the logging cable for recording and further processing. With the present invention, any desired number of accurate resistivity measurements can be made while the sonde is in the well bore in each formation of interest in the well bore during a single run. Further, fluid withdrawal can be continued until the sample is substantially free from mud filtrate contamination, based on the measured water resistivity, thus obtaining a valid reading of $R_w$.

DESCRIPTION OF PREFERRED EMBODIMENT

Figure 2:
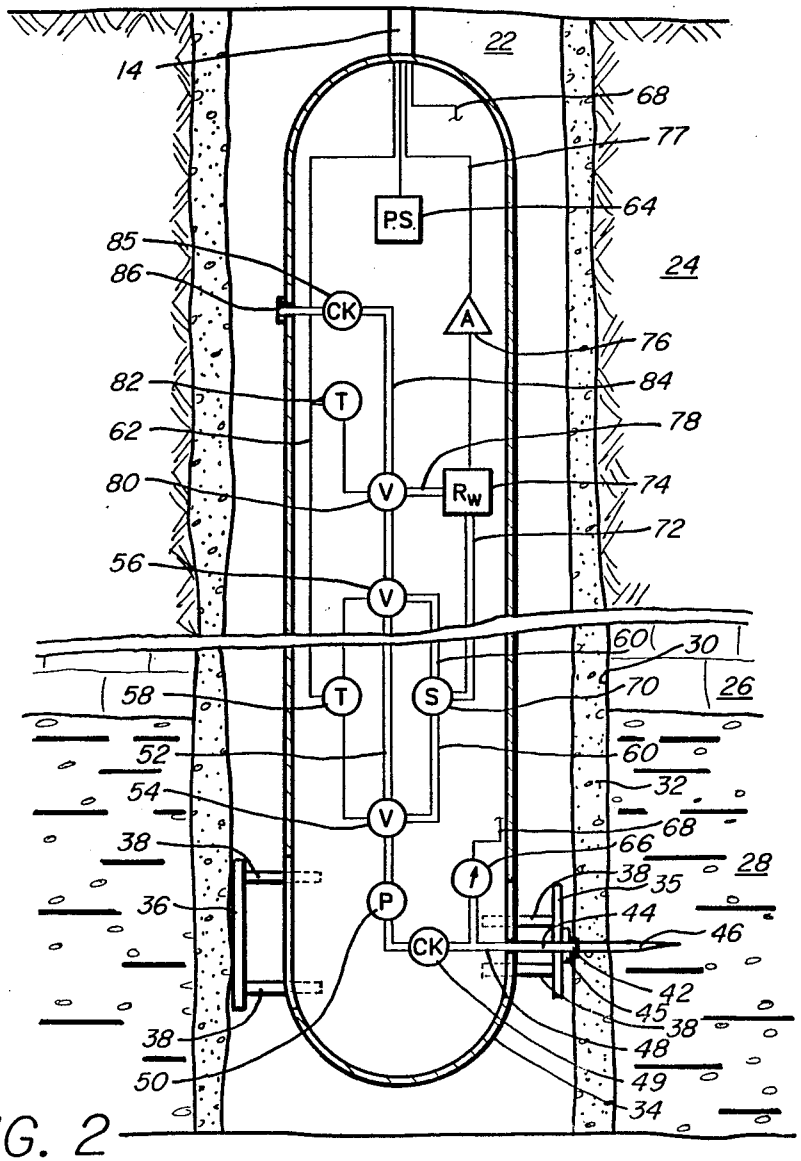
FIG. 2 is an enlarged elevation view, with formation contact pads extended, taken partly in cross-section, of a sonde portion of the formation testing system of FIG. 1.

In the drawings, the letter W designates generally a formation testing system in accordance with the present invention for measuring the resistivity of fluids in formations adjacent a well bore 10. The formation testing apparatus W includes a sonde 12 which is supported by an armored well logging cable 14 for movement in the well bore 10. As is conventional, the cable 14 passes over a sheave wheel 16 which forms a record of depth of the sonde 12 in the well bore 10. The cable 14 provides readings from the sonde 12 to a data computer/recorder 18 which is connected to a suitable data display 20. Depth readings from the sheave wheel 16 are also furnished to the data computer/recorder 18.

The sonde 12 is lowered into the well bore 10 through well borehole fluid 22 to a desired depth adjacent one or more formations 24, 26 or 28 of interest. Typically, the formation wall, such as indicated at 30 adjacent the well bore 10, is covered with a mud cake or coating 32 of drilling mud. The mud cake 32 has, by borehole pressure during drilling, driven a mud filtrate into the formation 28, forming a mixture with the formation fluid. As has been discussed, presence of mud filtrate in fluid samples from formations has severely hampered accuracy of formation fluid resistivity measurements in the past.

Figure 1:
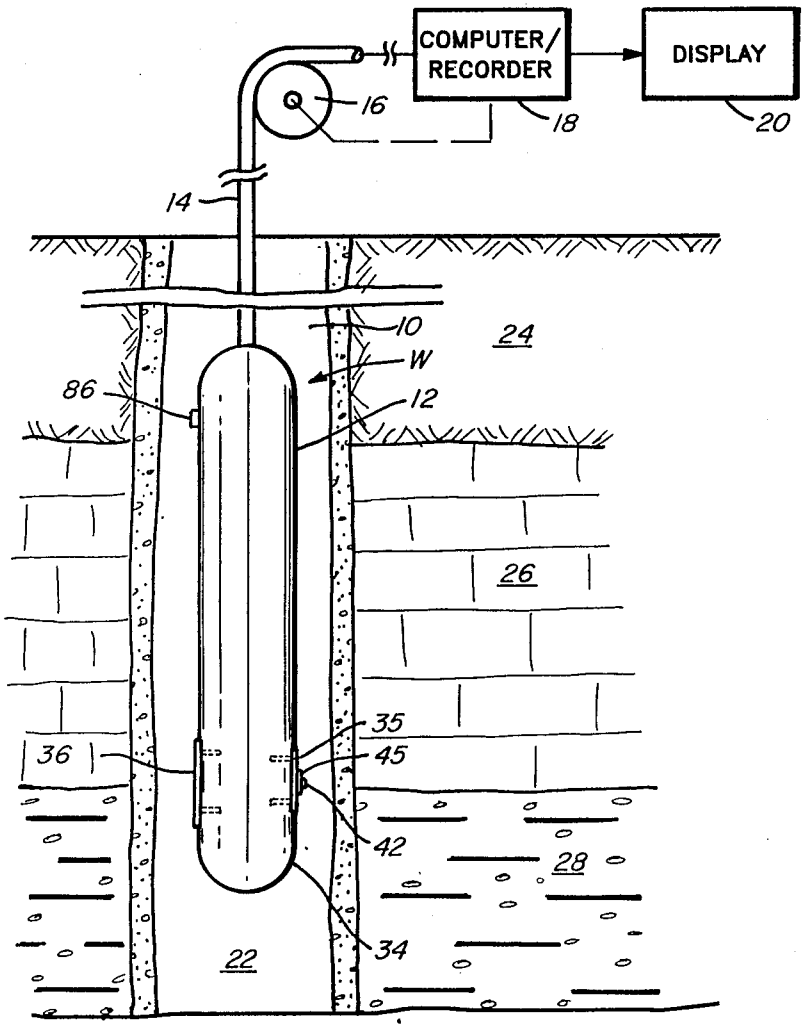
FIG. 1 is an elevation view, taken partly in cross-section, of a formation testing system according to the present invention.

The sonde 12 is an elongate enclosed body of metal of a suitable strength. Suitable seals are provided at appropriate places to prevent undesired fluid entry into the sonde 12. Mounted at a lower end 34 of the sonde 12 are a formation fluid sampling pad assembly 35 and a stabilizer pad assembly 36. The pad assemblies 35 and 36 may be of the type used, for example, in conventional multiple formation testers. The pad assemblies 35 and 36 are each mounted on shafts or arms 38 which are mounted for extension out of (FIG. 2) or retraction into (FIG. 1) the sonde 12. The pad assemblies 35 and 36 and extensor arms 38 are moved by conventional hydraulic actuators or operating motors in the sonde 12.

The pad assembly 35 has an inlet port 42 formed therein for allowing fluid from the formation, such as 28, to enter an extendable inlet conduit 44. As is conventional in earlier formation testers, a pad member 45 is activated to seal about inlet port 42 to inhibit entry of borehole fluid 22.

In situations where the formation is relatively impermeable and/or mud cake 32 is relatively thick or difficult to penetrate, a formation-penetrating bullet may be fired into formation 28 to form a fissure or opening 46 for passage of formation fluid. Also, in a cased well, a bullet may be used to perforate the well casing for formation testing in a cased well. The fluid entering the inlet port 42 is typically a mixture of mud filtrate and fluid from the formation 28. The fluid mixture from the inlet port 42 passes through from extendable inlet conduit 44 to a conduit or tube 48 in the sonde 12 and a check valve 49. The fluid mixture then moves to a pump 50, which moves the incoming mixture of fluids through a main conduit 52 in the sonde 12. The main conduit 52 conveys the fluid mixture received from inlet port 42 through the sonde 12.

A sample diverting valve 54 and a sample return valve 56 are located in the main conduit 52. The valves 54 and 56 are periodically commonly operated by an actuator 58 to divert a portion of the fluid mixture and obtain a sample from the main conduit 52 in a sample bypass conduit 60. The valve actuator 58 receives operating power and control signals over a conductor 62 from the armored well logging cable 14. A power supply 64 is provided in the sonde 12 to receive operating electrical power from the cable 14 for other components of the well logging system W.

A pressure gauge 66 is in fluid communication with the conduit 48 to obtain formation fluid pressure readings as a function of borehole depth. Readings so obtained in the pressure gauge 66 are conveyed over a conductor 68 in logging cable 14 to the data computer/-recorder 18.

A separator 70, such as centrifuge or other suitable separator, is located in sample bypass conduit 60. The separator 70 serves to separate water in the fluid mixture in bypass conduit 60 from relatively less dense oil or gas in the fluid mixture. A fluid sample conduit 72 transports the separated denser formation fluid (normally water) from the separator 70 to a resistivity measuring apparatus 74.

The resistivity measuring apparatus 74 may be either a conventional inductive resistivity measuring tool or one of the other conventional type, which uses electrodes, to obtain a measurement of the resistivity of the separated formation fluids. When the fluid in sample conduit has become substantially relatively denser formation water, resistivity measurements are made in the measuring apparatus 74 and amplified in amplifier 76. The measurements once amplified are then sent in either analog or digital format (as desired) over a conductor 77 through well logging cable 14 to the data computer/-recorder 18 at the surface for further processing, analysis and the like as desired. The remaining fluid from the formation fluid in the separator 70 is returned into the sample bypass conduit 60 to the sample return valve 56.

The denser formation fluid passes from the resistivity measuring tool 74 through a conduit 78 to a formation fluid return valve 80 in the main conduit 52. The denser formation fluid is there reintroduced into and mixed with the mud filtrate and other formation fluids from the main conduit 52. Formation fluid return valve 80 is controlled by a valve actuator 82. The fluid mixture in the main conduit 52 passes from the formation fluid return valve 80 to an outlet conduit 84 and through a check valve 85 to an outlet port 86 formed in the sonde 12 back into the well borehole fluid 22 in the borehole 10.

In the operation of the present invention, the sonde 12 is moved in the well bore 10 to a desired depth adjacent a formation 28 of interest. The pads 36 are brought into contact with the wall 30 of the borehole 10 so that the fluid inlet port 42 may begin receiving a mixture of formation fluid and mud filtrate. The pump 50 is activated and a large quantity of the fluid mixture is passed through the sonde 12. Periodically, sample diverting valves 54 and 56 are actuated to divert a portion of the fluid mixture into the bypass conduit 60.

The fluid mixture in the bypass conduit 60 then passes through the separator 70 where a portion of the denser formation water is separated and passed to the resistivity measuring tool 74. In the resistivity measuring tool 74, a formation fluid resistivity measurement is obtained. The measurement so obtained is then transmitted via the well logging cable 14 to the computer/recorder 18 at the surface.

As the sampling at a particular depth of interest continues over a period of time, the content of the fluid in sample conduit 60 becomes less contaminated by mud filtrate and thus a more accurate sample of formation fluid. Thus, resistivity measurements from measuring tool 74 become an accurate measure of formation fluid resistivity $R_w$.

The denser fluid sample then passes through conduit 78 and valve 80 back into the fluid passing through the main conduit 52. The fluid mixture exiting formation fluid return valve 80 goes into outlet conduit 84 and check valve 85 and then exits the sonde 12 at outlet port 86.

It is important to note that formation fluid samples may be repeatedly obtained and measurements of apparent $R_w$ obtained at the same depth in a formation of interest or at any of a desired number of depths in a formation of interest. Further, multiple readings may also be obtained in any desired number of formations adjacent the wellbore 10 with the formation testing system W of the present invention. Values of apparent $R_w$ can be transmitted from the sonde 12 to the surface data computer/recorder 18 over logging cable 14 in virtually real time in order to analyze whether or not a true $R_w$, or very nearly true $R_w$, (i.e., substantially free of mud filtrate) is being obtained.

When formation fluid flow begins, the measured $R_w$ begins at a value approximately that for mud filtrate. As fluid flow continues, the measured $R_w$ gradually changes to approach that for formation water only. $R_w$ measurements obtained with the formation testing system W of the present invention can then be interpreted along with the pressure fall-off data obtained from pressure gauge 66 to make an overall analysis of $R_w$, as well as other calculations necessary to obtain information about predicted production from formations of interest.

Having described the invention above, various modifications of the techniques, procedures, material and equipment will be apparent to those in the art. It is intended that all such variations within the scope and spirit of the appended claims be embraced thereby.

We claim:

1. A well logging tool for sampling resistivity of fluids in a formation adjacent a well bore, comprising:

a sonde;

means for conveying a mixture of fluids from the formation into said sonde;

a conduit in said sonde for receiving the mixture of fluids from said means for conveying;

means for moving the mixture of fluids through said conduit in said sonde;

means in said sonde for sampling the mixture of fluids moving through said conduit in said sonde;

means in said sonde for separating denser formation fluids from the mixture in the sample taken by said means for sampling; and means in said sonde for obtaining a measurement of the resistivity of the separated denser formation fluids.

2. The well logging tool of claim 1, wherein said means for conveying includes:

inlet means for admitting the mixture of fluids into said conduit in said sonde.

3. The well logging tool of claim 2, wherein said means for conveying includes:

outlet means for passing the mixture of fluids from said conduit means out of said sonde.

4. The well logging tool of claim 3, further including:

means sealing the well bore between said inlet means and said outlet means.

5. The well logging tool of claim 2, wherein said inlet means comprises:

a pad member mounted with said sonde and being selectively movable into engagement with the formation at a wall of the well bore; and an inlet port formed in said pad member.

6. The well logging tool of claim 5, further including:

means for sealing said pad member about said inlet port when said pad member is in engagement with the formation wall.

7. The well logging tool of claim 2, wherein said inlet means comprises:

an inlet port formed in said sonde.

8. The well logging tool of claim 1, wherein said means for moving comprises:

pump means mounted in said sonde in fluid communication with said means for conveying.

9. The well logging tool of claim 8, wherein said means for conveying includes:

inlet means for admitting the mixture of fluids into said sonde; and conduit means for transporting the mixture of fluids from said inlet means through said sonde.

10. The well logging tool of claim 1, wherein said means for periodically sampling comprises:

a bypass conduit; and means for periodically diverting a portion of the mixture of fluids in said means for conveying into said bypass conduit.

11. The well logging tool of claim 10, wherein said means for periodically diverting comprises:

a pair of valves selectively operable to connect said bypass conduit to said means for conveying.

12. The well logging tool of claim 11, further including:

means for actuating said pair of valves.

13. The well logging tool of claim 1, wherein said means for periodically sampling comprises:

separator means in fluid communication with said means for conveying.

14. The well logging tool of claim 13, wherein:

said separator means is in fluid communication with said means for obtaining a resistivity measurement.

15. The well logging tool of claim 14, further including:

means for re-introducing the formation fluid from said means for obtaining a resistivity measurement into said means for conveying.

16. The well logging tool of claim 1, wherein said means for obtaining a resistivity measurement comprises:

inductive means in said sonde for obtaining a measurement of the resistivity of the separated formation fluids.

17. The well logging tool of claim 1, wherein said means for obtaining a resistivity measurement comprises:

electrode means in said sonde for obtaining a measurement of the resistivity of the separated formation fluids.

18. The well logging tool of claim 1, further including:

a well logging cable for moving said sonde in the well bore.

19. The well logging tool of claim 18, further including:

means for sending the measurement of resistivity of the separated formation fluids to the surface through said well logging cable.

20. A method of sampling resistivity of fluids in a formation adjacent a well bore, comprising the steps of:

conveying a mixture of fluids from the formation into a sonde at a selected depth in the well bore;

moving the mixture of fluids through the sonde;

sampling the mixture of fluids moving in the sonde;

separating denser formation fluids from a sample of the mixture of fluids in the sonde taken during said step of sampling; and obtaining a measurement of the resistivity of the separated denser formation fluids.

* * * * *